US007856758B2

(12) United States Patent
Ressel et al.

(10) Patent No.: US 7,856,758 B2
(45) Date of Patent: Dec. 28, 2010

(54) ELECTROMECHANICAL DRIVE FOR A DOOR

(75) Inventors: Willi Ressel, Witten (DE); Ulrich Theile, Hagen (DE); Ralf Sojka, Schwerte (DE); Christian Dietz, Wipperfürth (DE)

(73) Assignee: Novoferm formatic GmbH, Dortmund (DE)

( * ) Notice: Subject to any disclaimer, the term of this patent is extended or adjusted under 35 U.S.C. 154(b) by 813 days.

(21) Appl. No.: 11/332,404

(22) Filed: Jan. 13, 2006

(65) Prior Publication Data

US 2006/0289128 A1 Dec. 28, 2006

(30) Foreign Application Priority Data

Jan. 14, 2005 (DE) ..... 10 2005 002 069
Nov. 8, 2005 (DE) ..... 10 2005 053 560

(51) Int. Cl.
*E05F 11/00* (2006.01)
*E05F 11/34* (2006.01)

(52) U.S. Cl. ..... 49/358; 49/362; 49/199

(58) Field of Classification Search ..... 160/188, 160/201; 192/30 W, 99 S; 49/358, 362, 49/199

See application file for complete search history.

(56) References Cited

U.S. PATENT DOCUMENTS 2,588,028 A * 3/1952 McNinch ..... 49/199
2,755,081 A * 7/1956 Johnson et al. ..... 160/188
3,775,906 A * 12/1973 Dougherty ..... 49/358
4,897,959 A * 2/1990 Worden ..... 49/18
4,931,708 A * 6/1990 Johnsen ..... 318/466
5,036,899 A * 8/1991 Mullet ..... 160/189
5,039,925 A * 8/1991 Schap ..... 318/282
5,148,020 A * 9/1992 Machida ..... 250/231.16
5,698,073 A * 12/1997 Vincenzi ..... 160/188
5,746,025 A * 5/1998 Shimura ..... 49/360

(Continued)

FOREIGN PATENT DOCUMENTS

DE 1 584 243 10/1969

(Continued)

OTHER PUBLICATIONS

Dictionary.com. Dictionary.com Unadbridged (v 1.1) Random House, Inc. http://dictionary.reference.com/browse/transmission.*

(Continued)

*Primary Examiner*—Katherine W Mitchell
*Assistant Examiner*—David E Allred
(74) *Attorney, Agent, or Firm*—Cohen, Pontani, Lieberman & Pavane LLP

(57) ABSTRACT

The invention concerns an electromechanical drive for a door or the like, with a motor and a transmission, which are connected with each other, wherein a drive gear in the form of a gear wheel or the like is present on a drive shaft of the transmission and cooperates with means for moving the door or the like, preferably in or on a guide rail. The drive has a modular design, and it has a compact power unit that can be used with different types of mounting units for different doors. In this regard, the power unit is equipped with a standard mounting bracket. In addition, different housings can be used for different areas of application.

16 Claims, 16 Drawing Sheets

U.S. PATENT DOCUMENTS

| | | | | |
|---|---|---|---|---|
| 5,761,850 | A * | 6/1998 | Lhotak et al. | 49/360 |
| 6,279,268 | B1 * | 8/2001 | Beaudoin et al. | 49/322 |
| 6,401,792 | B1 * | 6/2002 | Mullet et al. | 160/188 |
| 7,048,029 | B2 * | 5/2006 | Rieder et al. | 160/188 |
| 7,299,847 | B1 * | 11/2007 | Evans | 160/1 |
| 2003/0025470 | A1 * | 2/2003 | Fitzgibbon et al. | 318/66 |
| 2003/0205338 | A1 * | 11/2003 | Mullet et al. | 160/188 |

FOREIGN PATENT DOCUMENTS

| | | | |
|---|---|---|---|
| DE | 7329024 | U | 12/1973 |
| DE | 9300400 | U1 | 2/1993 |
| DE | 4343695 | A1 | 6/1995 |
| DE | 29809641 | U1 | 12/1998 |
| DE | 100 03 160 | | 3/2001 |
| EP | 0816619 | A1 | 1/1998 |
| EP | 1 176 280 | | 1/2002 |
| JP | 6003958 | A | 1/1994 |
| JP | 6033674 | A | 2/1994 |
| JP | 11200705 | A | 7/1999 |
| JP | 2000265741 | A | 9/2000 |
| JP | 2003082922 | | 3/2003 |

OTHER PUBLICATIONS

Dictionary.com. Dictionary.com Unadbridged (v 1.1) Random House, Inc. http://dictionary.reference.com/browse/clutch.*

Dictionary.com. Dictionary.com Unadbridged (v 1.1) Random House, Inc. http://dictionary.reference.com/browse/transmission (definition provided in action).*

Dictionary.com. Dictionary.com Unadbridged (v 1.1) Random House, Inc. http://dictionary.reference.com/browse/clutch (definition provided in action).*

* cited by examiner

ELECTROMECHANICAL DRIVE FOR A DOOR

BACKGROUND OF THE INVENTION

1. Field of the Invention

The invention concerns an electromechanical drive for a door or the like, with a motor and a transmission, which are connected with each other, wherein a drive gear in the form of a gear wheel or the like is present on the drive shaft of the transmission and cooperates with means for moving the door or the like, preferably in or on a guide rail. The invention includes a door drive for moving a single-section door leaf or multiple-section door leaf along a guide rail. The door drive is intended to be used, for example, for tip-up doors, overhead sectional doors, side sectional doors, and sliding doors.

2. Description of the Related Art

EP 1 176 280 A1 describes a door, especially a garage door with a door leaf and a runner rail on each side of the door leaf. It has an electric door drive for opening and closing the door leaf. In addition, a flexible track element is provided on the runner rail. The door drive has a drive motor with a drive gear, which is guided in the runner rail. The track element is partially wound around the drive gear. During a drive motion of the drive gear, the drive motor can be moved along the runner rail by positive locking and/or frictional locking of the drive gear with the underside of the track element that faces the runner rail.

DE 100 03 160 C1 describes a door with an electric door drive that is installed directly on the inside of a single-section door leaf or multiple-section door leaf. The door drive has a motor/transmission unit, which drives a track roller that engages a lateral guide rail of the door. It is also advantageous for the track roller to be designed as a gear wheel that meshes with a toothed belt stretched in the runner rail or a toothed section formed on the runner rail.

DE 1 584 243 A1 discloses a drive for large tip-up doors, in which the door leaf is connected by track rollers in lateral rails by means of a continuous shaft, which is driven by a geared motor or the like via a chain drive or the like. The geared motor is permanently mounted near this shaft and the upper edge of the door leaf on the door leaf itself.

U.S. Pat. No. 2,755,081 discloses a drive, which is also mounted on the door leaf and is connected by a pinion with a toothed profile, which is mounted on the guide rail. In addition, the geared motor is mounted on a mounting plate, which is mounted on the door leaf. A clutch is provided between the output shaft of the motor and an angular gear.

As the aforementioned prior art shows, in accordance with these well-known measures, the door drives are always structurally adapted to a specific type of door and are not interchangeable. In this regard, they have overall different designs. Use with different types of doors is not possible. In addition, door manufacturers have different manufacturer's specifications, for example, with respect to the arrangement and design of the guide rails. This large number of types complicates the maintenance of spare parts inventories.

SUMMARY OF THE INVENTION

Proceeding on the basis of this technological background, an object of the invention is to create a universal electromechanical door drive. This is intended especially to achieve a drastic reduction of manufacturing costs as well as a reduction of stockkeeping costs. It is intended that it be possible for a universal electromechanical door drive of this type to be used for all current types of doors and nevertheless satisfy regulatory requirements.

In accordance with the invention, an electromechanical door drive for moving a single-section door leaf or multiple-section door leaf along a guide rail vertically or horizontally and, in one embodiment, for moving a swing door or swing door leaf, is provided with a universal drive module (power unit) containing all necessary drive train parts. These include especially a motor, a transmission, a drive gear, a mounting bracket, and a position-detecting unit. This power unit can be connected with door-specific, different mounting units. The mounting units simultaneously represent the interface to the various types of gates and doors.

The power unit has a compact design and thus can be used, regardless of the size of the door, for any door type and any size. A power unit of this type can be produced inexpensively in large quantities.

To be able to use a power unit of this type, it is necessary to have a mounting bracket that is standardized to some extent. A mounting bracket of this type is necessary to ensure adaptation to the differently designed mounting units. The large variety of mounting units necessarily results from their use with a large variety of door types. The mounting unit is the interface between the power unit and the door. For this reason, the mounting unit includes a base plate, which can have a variety of designs and, in addition, has openings that are suitable for mounting it on the door leaf that is used. The base plate has lateral sections extending from it, which can be combined with mounting flanges formed on the lateral sections as extensions thereof. In at least one of the mounting flanges, corresponding to the mounting bracket of the power unit, there is a recess and mounting means for connecting the power unit to the mounting unit.

In addition, the mounting unit has a rotatably supported shaft, which is provided with a pinion and a track roller that is mounted at the end and engages the guide rail. After the power unit has been connected with the mounting unit, the gears of both the power unit and the mounting unit engage each other, so that a rotational motion of the motor can be transmitted to or in the guide rail.

It turns out that this type of adaptation to the specific type of door by a suitably designed mounting unit allows universal use of the power unit. This is possible even for different types of doors and for doors produced by different manufacturers. In addition, the mounting unit mounted on the door leaf can be structurally freely designed. A standardized mounting bracket or a connection adapted to the specific circumstances can be selected for the connection between the power unit and a different mounting unit.

In accordance with a preferred first embodiment, a mounting unit of this type, which is mounted on the door leaf, is designed as a U-shaped sheet-metal part. Besides the aforementioned mounting fixture, flange facings for mounting a housing can also be provided on one of the lateral sections of the mounting unit.

The track roller of the mounting unit can be designed as a gear wheel, which meshes with a toothed section of the guide rail or with a toothed belt stretched in the guide rail. Instead of a toothed belt, it is also possible to use chains, cords with pearl-like knobs, or the like. A track wheel support can be rigidly mounted or rotatably supported on the shaft of the mounting unit. The track wheel support supports at least one guide roller that runs in the guide rail. The guide roller runs, for example, on the back of a toothed belt stretched in the guide rail and ensures that the track roller maintains belt contact.

It is likewise advantageous to design the mounting bracket of the power unit as a structural section. In this regard, the motor and transmission are mounted on the outer side of a shank of the mounting bracket. In a preferred embodiment of the invention, the power unit includes a clutch, which is mounted on the shaft or in a train with the shaft. This makes it possible to mount the clutch, for example, displaceably within the U-shaped support of the mounting bracket by means of a clutch release lever in the axial direction of the shaft. In addition, a spring-loaded lever is pivoted on the mounting bracket, which allows a shifting movement from the first shift position to the second shift position to disengage the clutch and locks the clutch release lever in the second shift position. Furthermore, a restoring device, for example, a compression spring, is assigned to the clutch release lever, so that the clutch release lever automatically returns to the first shift position when the lever that locks the clutch release lever in the second position is set back.

In a further refinement of the invention, a switch for determining the position of the lever is assigned to the lever. The functional positions "open"/"closed" of the switch indicate the position of the clutch. The switching signal can be displayed, for example, as an optical and/or acoustic signal, which lets the user know whether the door drive is unlocked and the door can be manually operated. The signal can be additionally used to control the door drive. For example, when the clutch is disengaged, the door drive is automatically shut off, and it is automatically turned on when the clutch is engaged.

In addition, the power unit includes a position-detecting device, which is very precise and comprises a combination of various hardware components together with an automatic control circuit. A suitable position detecting device is disclosed in U.S. Pat. No. 7,339,338, which is incorporated herein by reference.

The position-detecting device consists essentially of an information transmitter and an electronic control unit. The data transmitter consists of an information carrier and a sampling system. Identical information content is formed at uniform intervals along the periphery of the data transmitter, such that unambiguous recognition of a complete revolution of a data transmitter is made possible either by a nonuniform interval or by nonuniform information content. The determined data can be additionally used to realize added-feature functions. In addition, position detection of this type reliably guarantees the proper start or continuation of a sequence of movements even in the event of temporary disruption or interruption of this sequence.

For the first time, a power unit of this type allows a total sequence of movements of a door to be completely detected, to acquire the data centrally in a position-detecting device, and to process it there. In this regard, it is possible to use the data to check and control various parameters. This solution eliminates mechanical limit switches, since the positions are programmed and are reliably determined by the position-detecting device.

The data transmitter thus supplies an unambiguous information content of a complete revolution by a nonuniform interval. This "void" makes it possible to determine the exact position of the door in both directions of rotation.

A data transmitter of this type can be realized, e.g., as an incremental transmitter. Its basic structure consists essentially of a light barrier, which is permanently integrated in an electronic circuit, and an information carrier that is operatively connected with the light barrier. This information carrier can be mounted, for example, directly on the drive shaft of the drive motor or of the transmission inside a power unit. The incremental transmitter, together with its electronic circuit, is likewise realized as a replaceable module. The information carrier can have a wide variety of embodiments, with disk-shaped, crown-shaped, or pot-shaped embodiments being preferred. The information content necessary for determining the position is present on the periphery of the information carrier. This information content can be in the form of projecting or spaced regions or elements, which extend in a plane or perpendicularly to the plane of the information carrier in certain sections or segments. Teeth that are separated by grooves have been found to be especially effective. Other embodiments are possible whenever clearly detectable signals can be obtained.

Due to the different areas of application of the power unit in conjunction with different mounting units, it is possible to use different housings.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
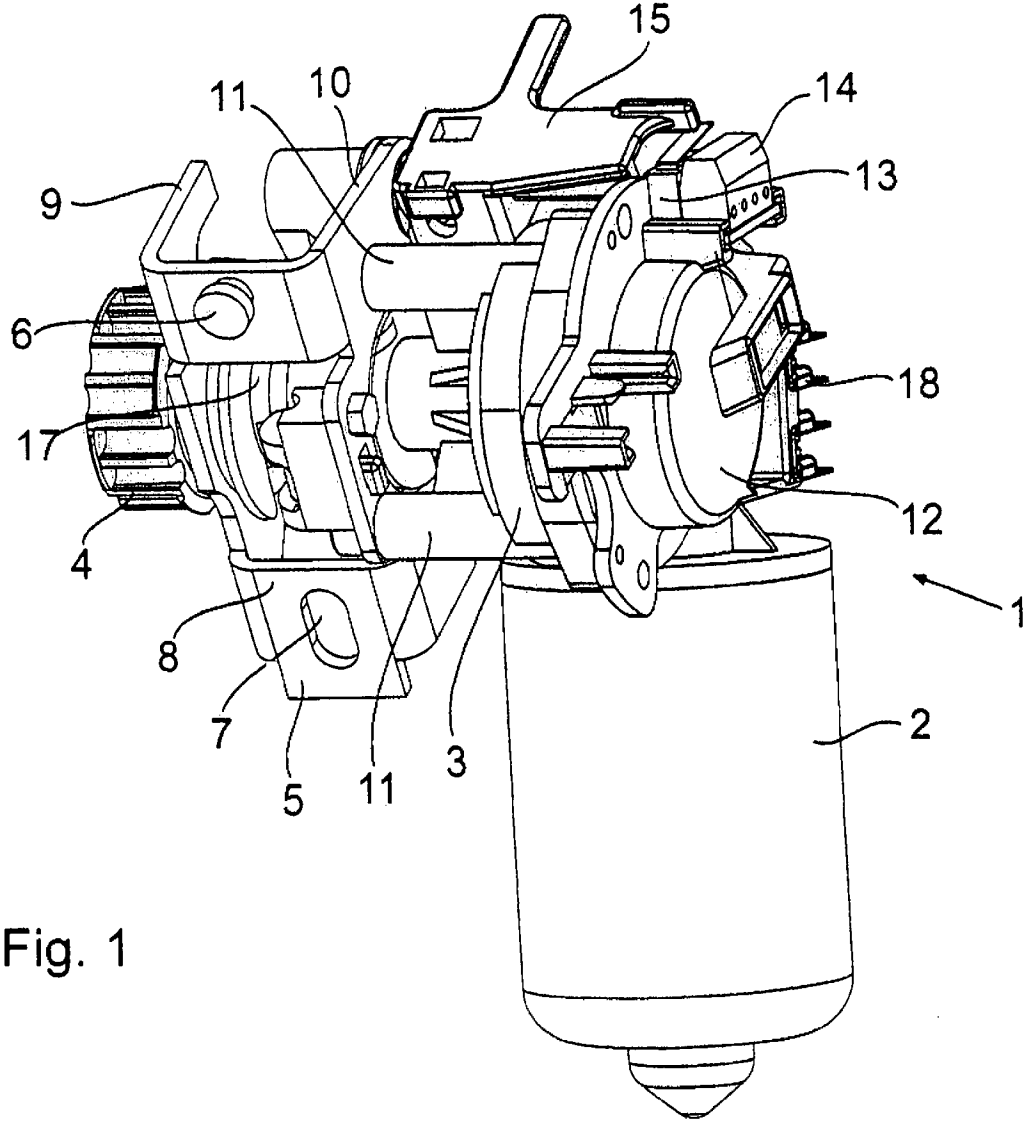
FIG. 1 is a perspective view of a power unit.

FIG. 1 shows a perspective view of a power unit 1, which has a compact construction and can be realized inexpensively by virtue of the fact that it can be produced in large quantities and can be used for different drives. The power unit 1 consists essentially of a motor 2, a transmission 3, a connecting clutch 17, and a connected drive gear 4. The motor 2 is supplied with the necessary electric power by a motor connection 18 in the form of plug elements. A position-detecting unit 12 is supplied with electric power via a connecting terminal 14, and the data acquired in the position-detecting unit 12 is also retrieved via the connecting terminal 14 and passed on to a control unit (not shown). The motor 2 and the transmission 3 are frictionally and positively connected with a mounting bracket 5 by spacers 11. The mounting bracket 5 is the connecting element between the power unit 1 and a mounting unit, which will be described in greater detail later. To realize universal mounting, the mounting bracket 5 has a mounting fixture 6 and a slot 7. The mounting fixture 6 is designed in such a way that it can be inserted into a complementary recess on a mounting unit and thus guarantees that the power unit 1 is securely locked in place even before bolting through the slot 7. The slot 7 and the mounting fixture 6 are located in base shanks 8 of the mounting bracket 5, which are joined to lateral mounting shanks 9, 10. The mounting bracket 5 is thus a simple U-shaped structural member. The spacers 11 are bolted to the mounting shank 10.

Figure 2:
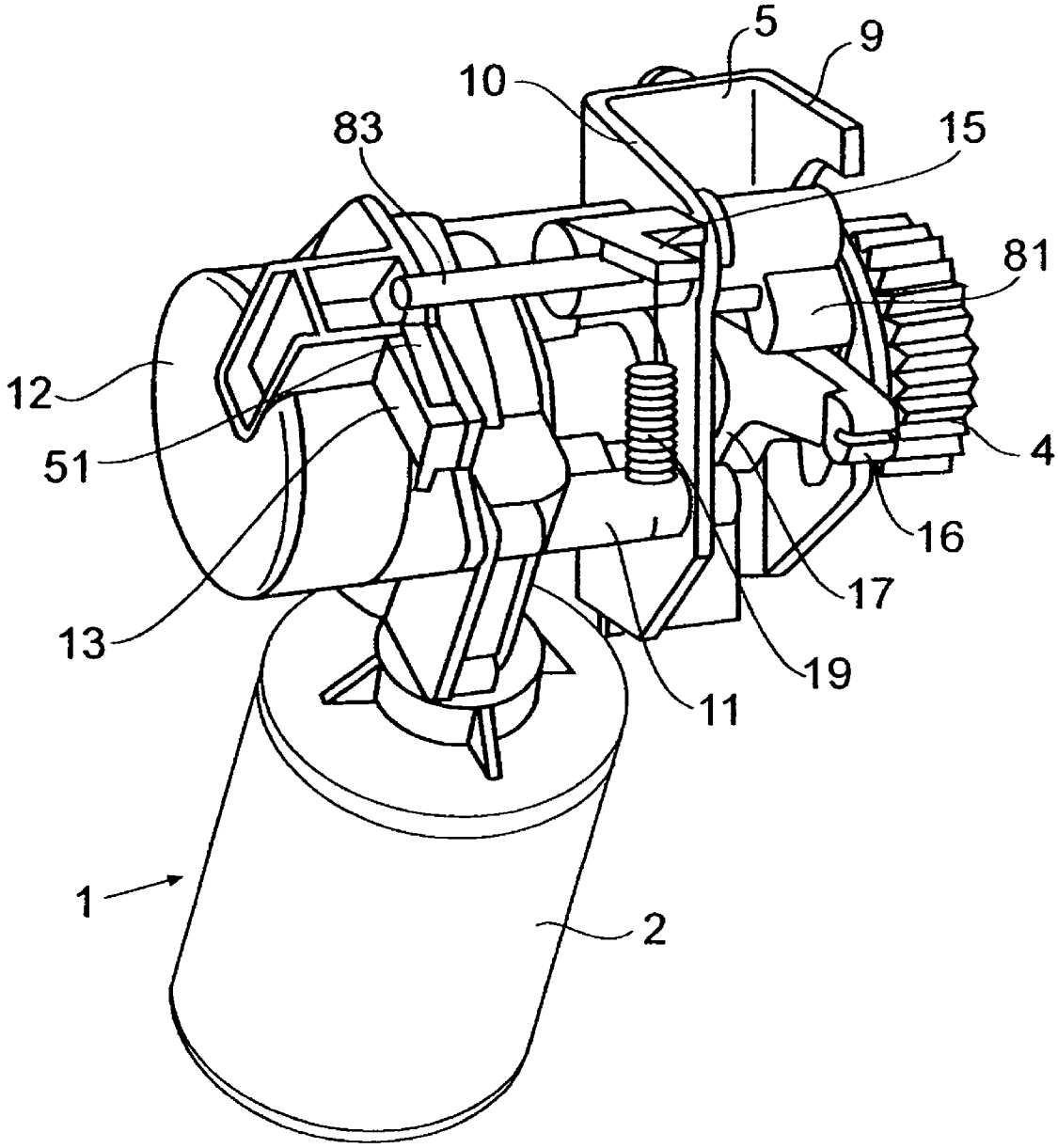
FIG. 2 shows the same power unit as FIG. 1 but rotated 180°.

FIG. 2 shows the power unit 1 of FIG. 1 from the opposite side to reveal a switch 13 with a switch spring 51. The switch 13 indicates the shift state of the clutch 17. When a clutch release lever 16 is operated, it is swung out of the area of a cam 81. This also causes the cam 81 to swivel due to the action of a spring 19, which in turn causes an operating pin 83 on a lever 15 to drop, which thus operates the switch spring 51 of the switch 13.

Figure 3:
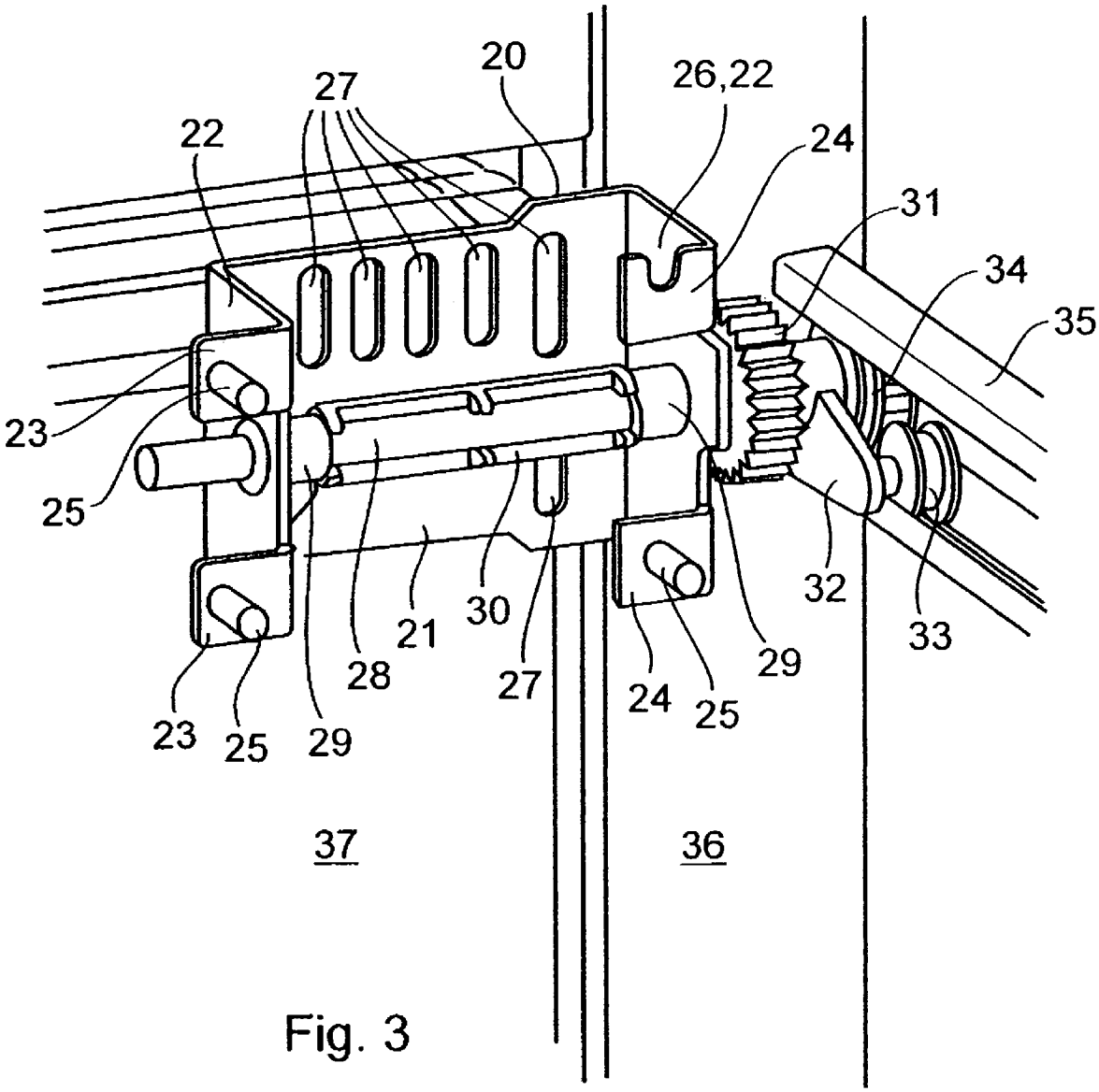
FIG. 3 shows a first mounting unit on a tip-up door.

The drawings in FIGS. 1 and 2 show that the power unit 1 is a standard part and can be produced and later used completely independently of the type of door. To now use the power unit 1 described above in a tip-up door, a specific mount is needed. An example of such a mount is shown in FIG. 3 as the first mounting unit 20. This mounting unit 20 consists of a base plate 21 with lateral sections 22 extending from it. Mounting flanges 23 and 24 are formed on the ends of the lateral sections 22. A mounting unit 20 of this type can be easily produced as a stamped and formed sheet metal part, the sections 22 being bent. The mounting unit 20 is mounted on the door leaf 37 by means of apertures in the form of vertically oriented slots 27 in the base plate 21.

A shaft 28 is inserted in the lateral sections 22 and supported by journal bearings 29. In the middle region of the base plate 21, the shaft 28 has an additional shaft guide 30.

A coupling pinion 31 is connected with the shaft 28 at the outlet end of the shaft 28 (on the right side in FIG. 3). Following the coupling pinion 31, there is a track roller 34, which is shown within a guide rail 35 connected with a guide roller 33, which is mounted on a roller bracket 32. The guide rail 35 is mounted on a jamb 36 of the door leaf 37.

At one end, the mounting flange 24 has a recess 26 for the mounting fixture 6 on the mounting bracket 5 of the power unit 1, and at the other end, it has a threaded stud 25 that fits into the slot 7 of the mounting bracket 5. The power unit 1 can be securely, easily, and interchangeably connected with the mounting unit 20 by a nut (not shown).

The threaded bolts 25 present in the mounting flange 23 are used for the subsequent mounting of a housing 40.

Figure 4:
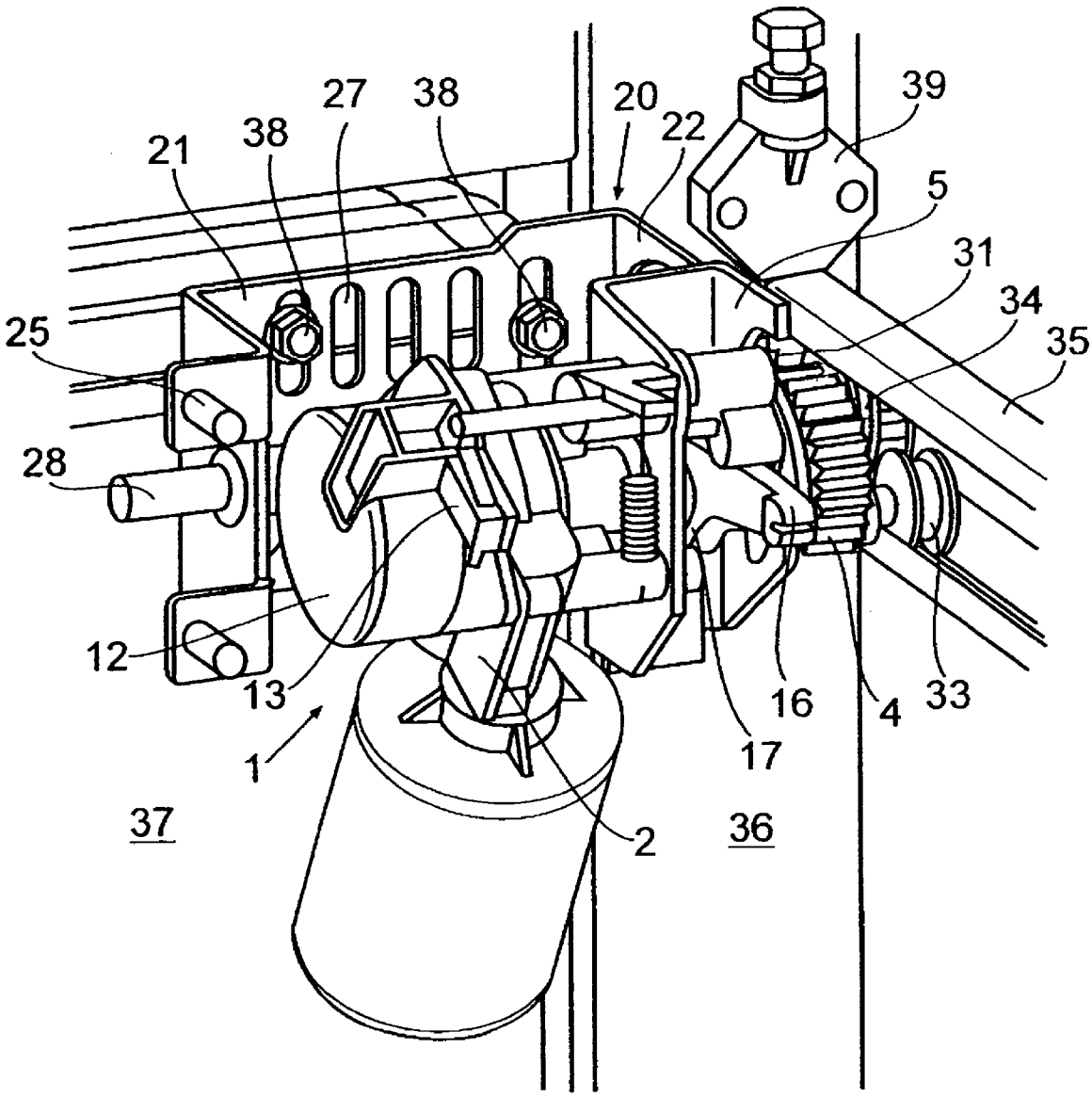
FIG. 4 shows the mounting unit of FIG. 3, with the power unit of FIGS. 1 and 2.
Figure 5:
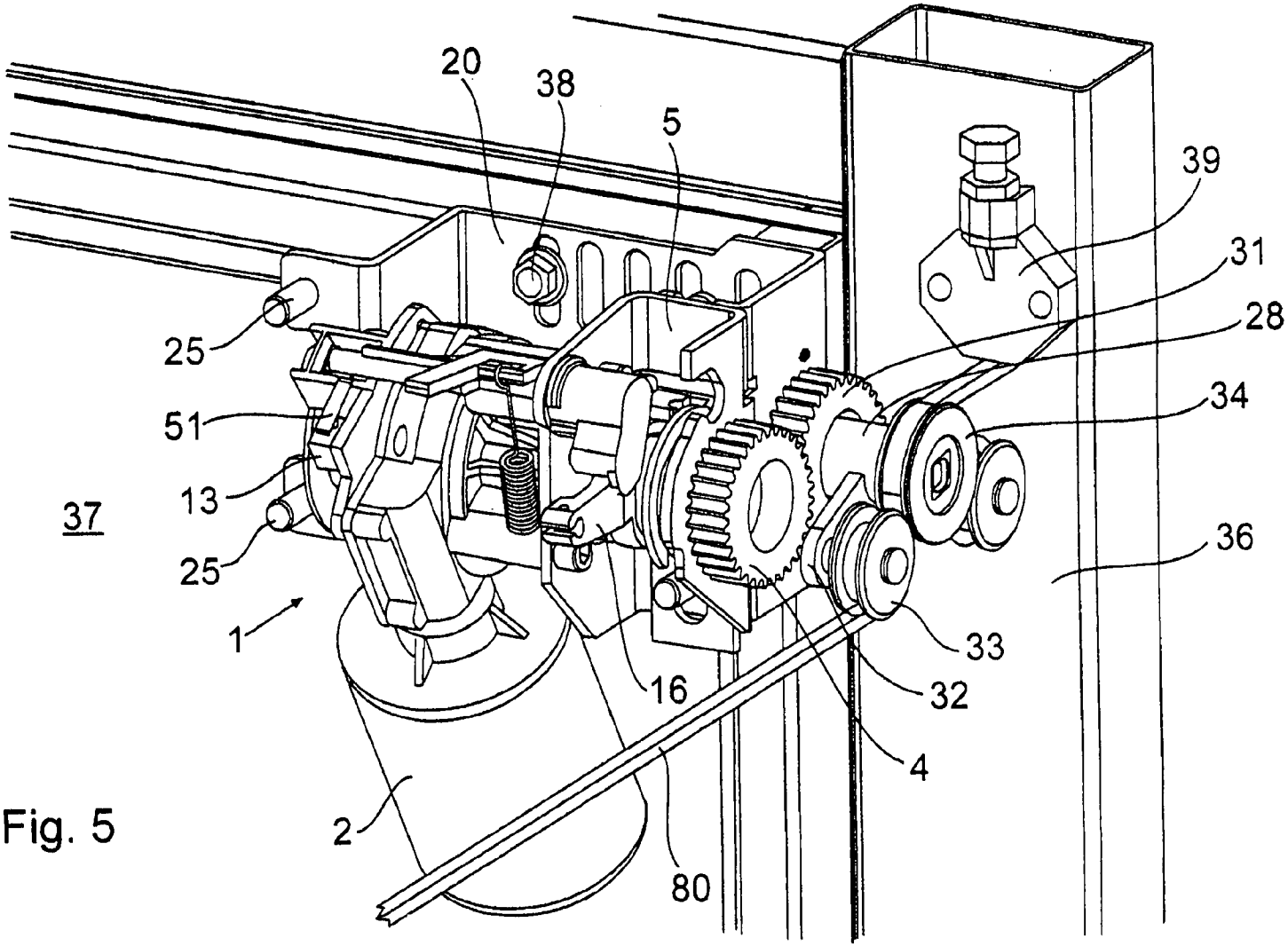
FIG. 5 shows a different view of the mounting unit and power unit, and their interaction with a traction mechanism.

FIG. 4 shows the power unit 1 connected with the mounting unit 20 in the manner described above. At the same time, the drive gear 4 and the coupling pinion 31 have been placed in a state of driving connection. This driving connection is more readily apparent in FIG. 5. The rotational motion of the motor 1 is thus transmitted by the moving members to the coupling pinion 31 and the shaft 28 to the track roller 34. In the embodiment of FIG. 5, the track roller 34 is connected with a fixed belt 80, so that during rotary motion of the motor 2, the door leaf 37 can be moved due to the connection to the fixed belt 80, which is preferably a toothed belt and can be tensioned by a tensioning device 39 fixed to the doorjamb 36.

Figure 6:
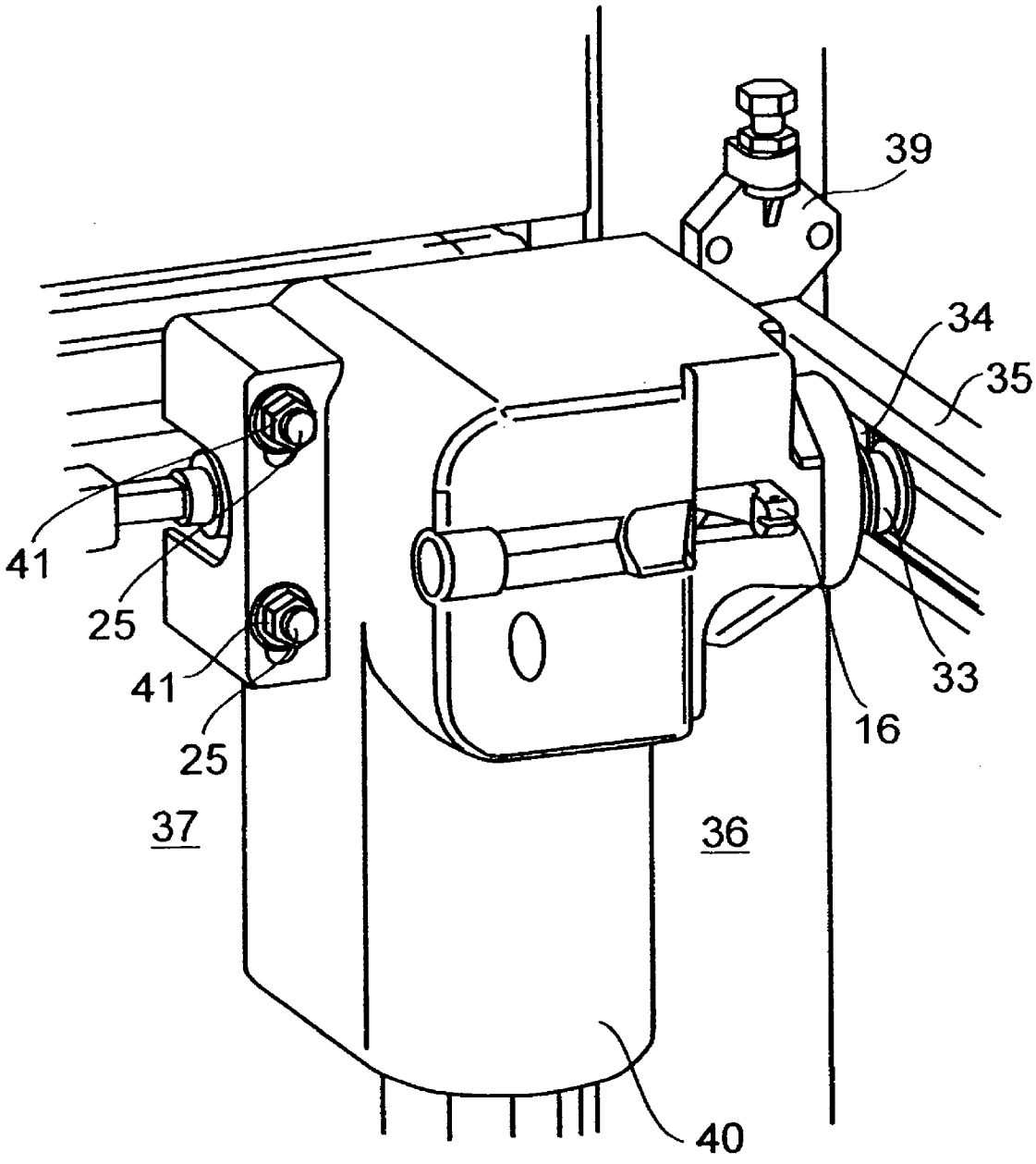
FIG. 6 shows the power unit shown in FIGS. 4 and 5 with a housing.

As shown in FIG. 6, the power unit 1 with the mounting unit 20 is securely enclosed by a housing 40. The housing 40 is mounted on the threaded bolts 25 by means of nuts 41. The clutch release lever 16 for disengaging the clutch 17 extends out of the housing 40.

Figure 7:
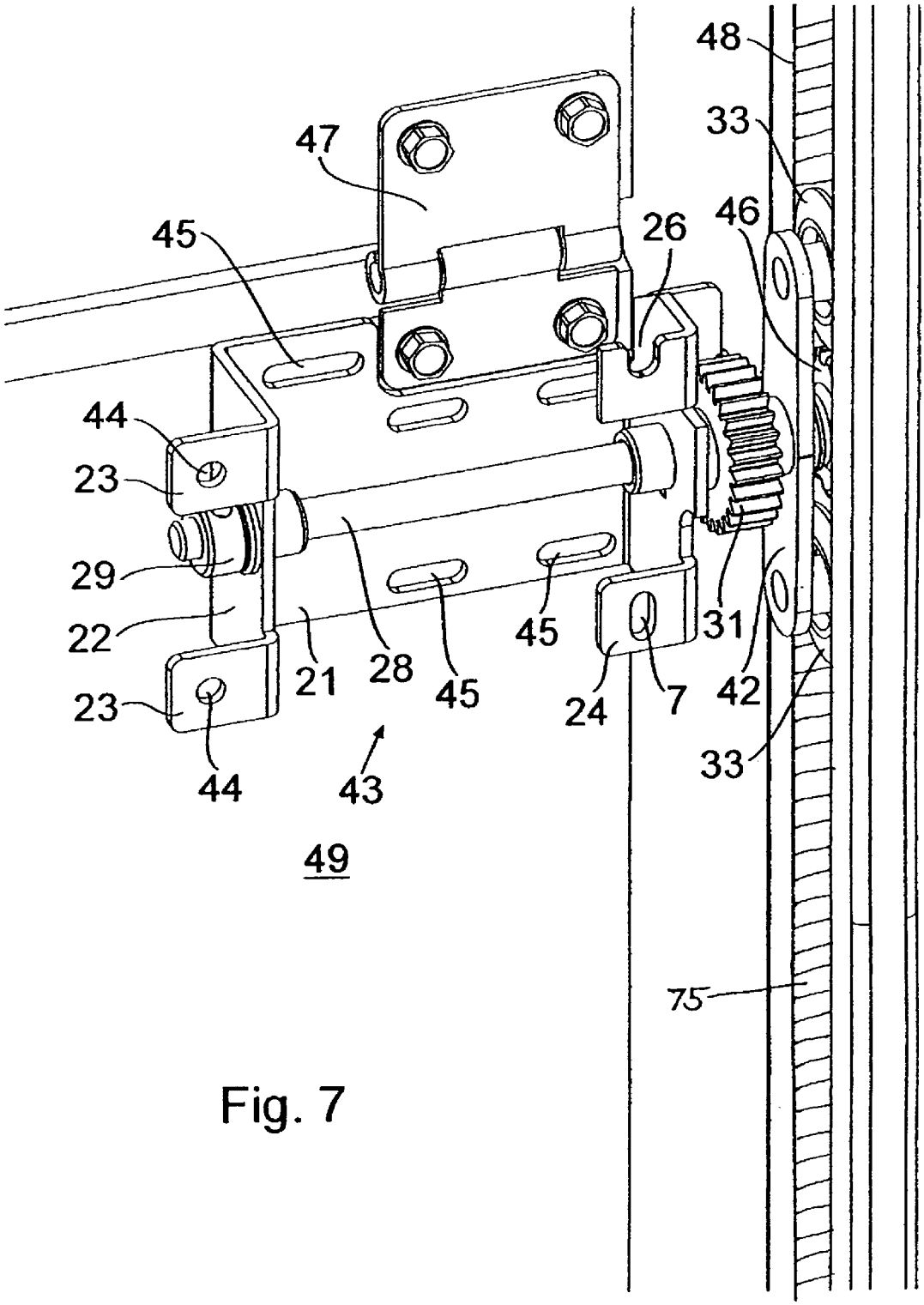
FIG. 7 shows a second embodiment of a mounting unit for a sectional sliding door.

FIG. 7 shows a second embodiment of a mounting unit 43. In this case, the base plate 21 has apertures in the form of transversely oriented slots 45 to provide a connection to a section 49 of a sectional door. The shaft 28 with the coupling pinion 31 extends through a roller bracket 42, which contains a driving pinion 46 and guide rollers 33. As FIG. 7 shows, a running rail 48 is vertically mounted in this case due to the type of door selected, namely, a sectional door. In this regard, a pinion engaging means such as a toothed belt or a rack 75, which interacts with the driving pinion 46 and can thus cause the sectional door to open and close, is present within the running rail 48.

Figure 8:
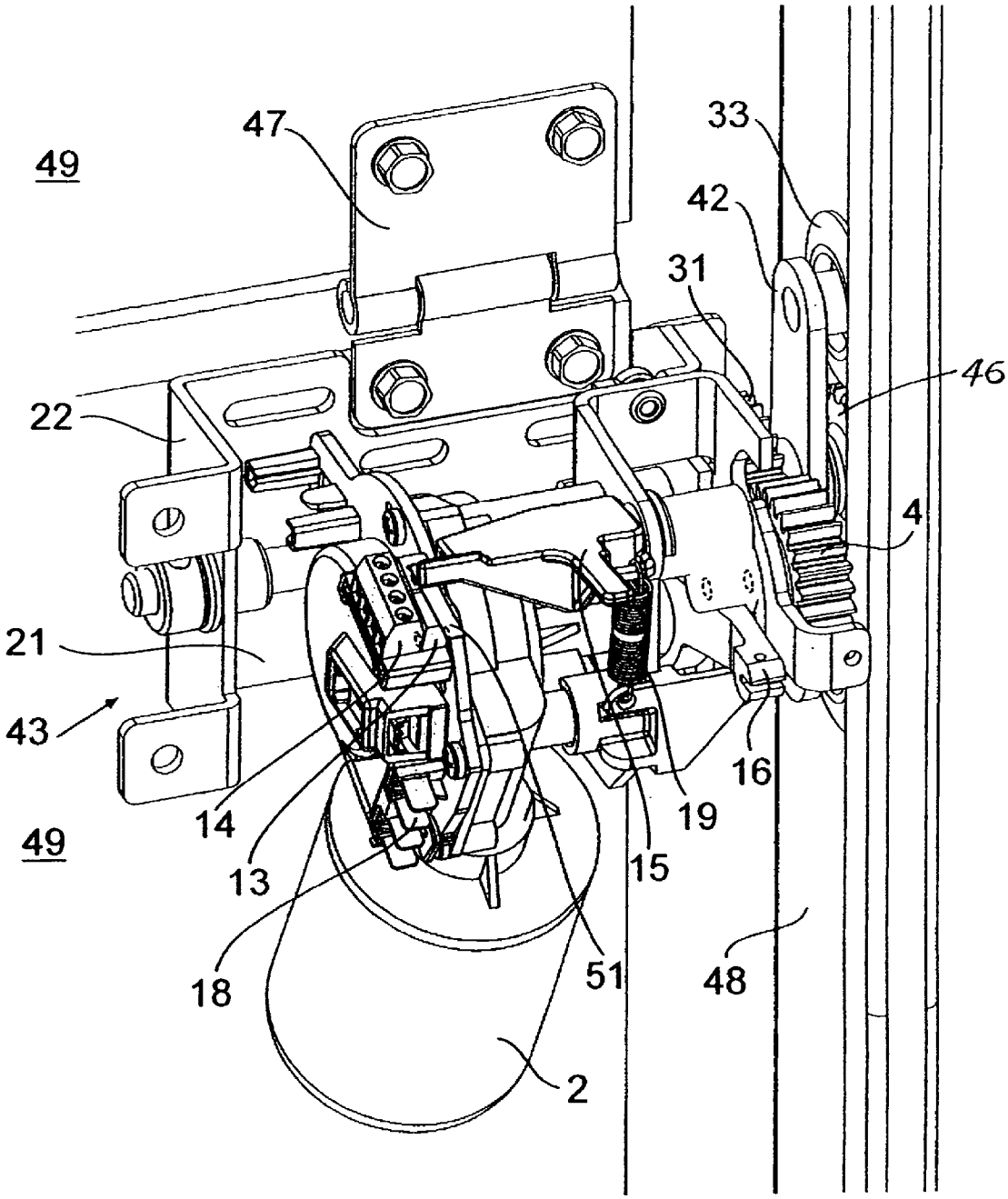
FIG. 8 shows the mounting unit of FIG. 7 with a power unit.

FIG. 8 shows the combination of the power unit 1 and the mounting unit 43. In this case as well, after the connection of the power unit 1 with the mounting unit 1, the drive gear 4 is connected with the coupling pinion 31 to allow the transmission of power. The individual sections 49 of the sectional door are rotatably connected with each other by hinges 47.

In a modification of the first mounting unit 20, mounting unit 43 has mounting holes 44 in the mounting flange 23 for the housing. The mounting holes 44 are preferably threaded.

Figure 9:
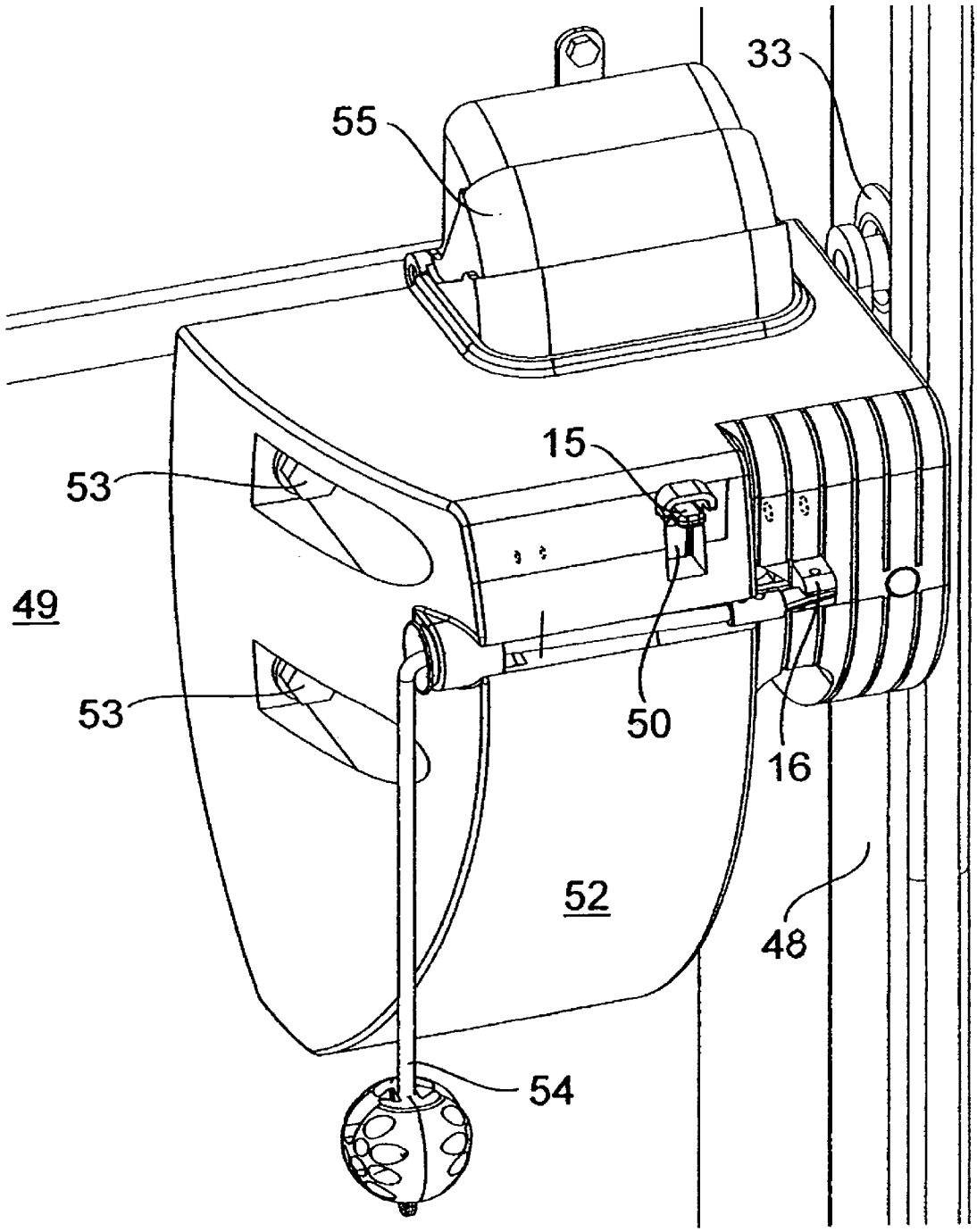
FIG. 9 shows the units of FIG. 8 enclosed in a housing.

FIG. 9 shows the covering of the above-described embodiment of FIGS. 7 and 8 with a housing 52. The housing 52 is mounted by fastening bolts 53 that fit into the mounting holes 44.

In this case, the clutch release lever 16 has been provided with an actuating element in the form of a cable 54, to allow the drive to be disengaged from the power unit 1. Furthermore, the housing 52 has an opening 50, through which the lever 15 extends. The hinge 47 is covered by a hinge safety cover 55 to prevent bodily injury.

Figure 10:
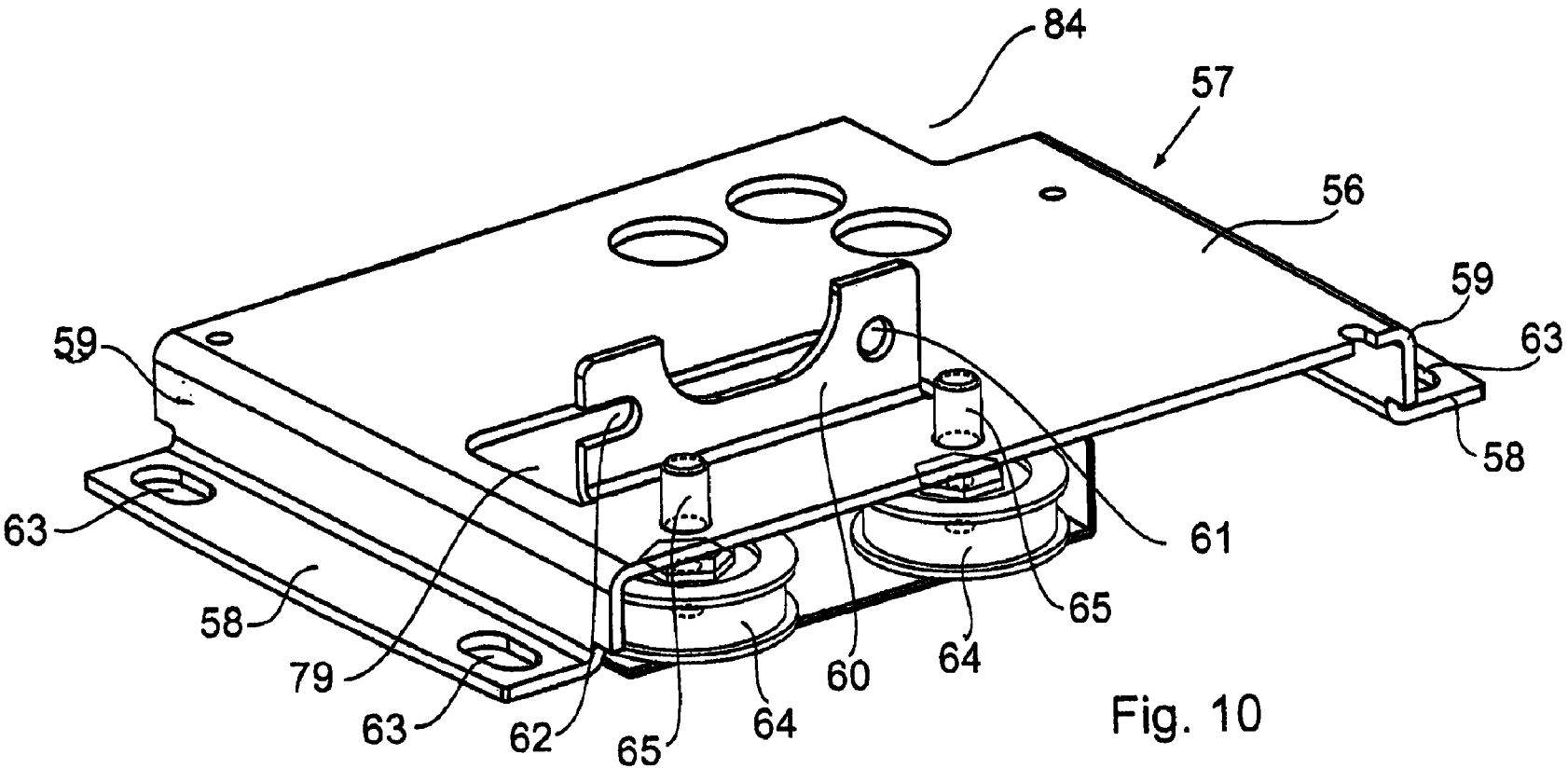
FIG. 10 is a perspective view of a third embodiment of a mounting unit.

In a third embodiment of a mounting unit 57, which is shown in FIG. 10, the mounting unit 57 has the same design with its base plate 56 and laterial sections 59 with mounting flanges 58 formed on them, but the base plate 56 has an opening 79 flanked by a mounting flange 60 formed by a bent section. The mounting flange 60 is provided with a recess 62 and a mounting hole 61 to allow secure mounting of the power unit 1 by means of the mounting bracket 5.

The mounting unit 57 shown in FIG. 10 is designed for a stationary drive. In this regard, the mounting unit 57 is mounted on a panel or a running rail by means of aperture in the form of slots 63 in the mounting flanges 58. Guide rollers 64 for a drive device such as an endless belt (not shown) are rotatably supported in the mounting unit 57 on shafts 65.

Figure 11:
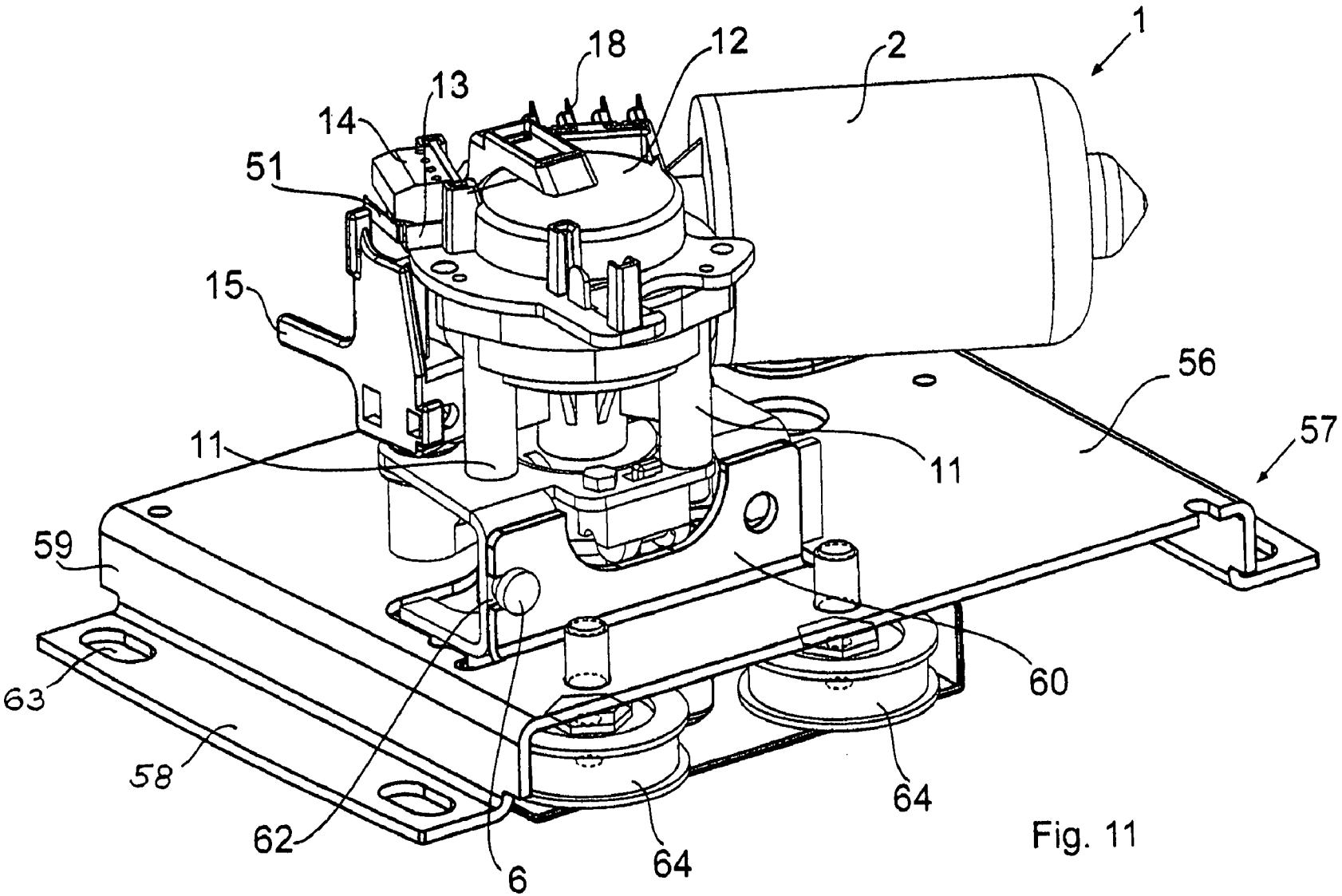
FIG. 11 shows the mounting unit of FIG. 10 with a power unit.
Figure 12:
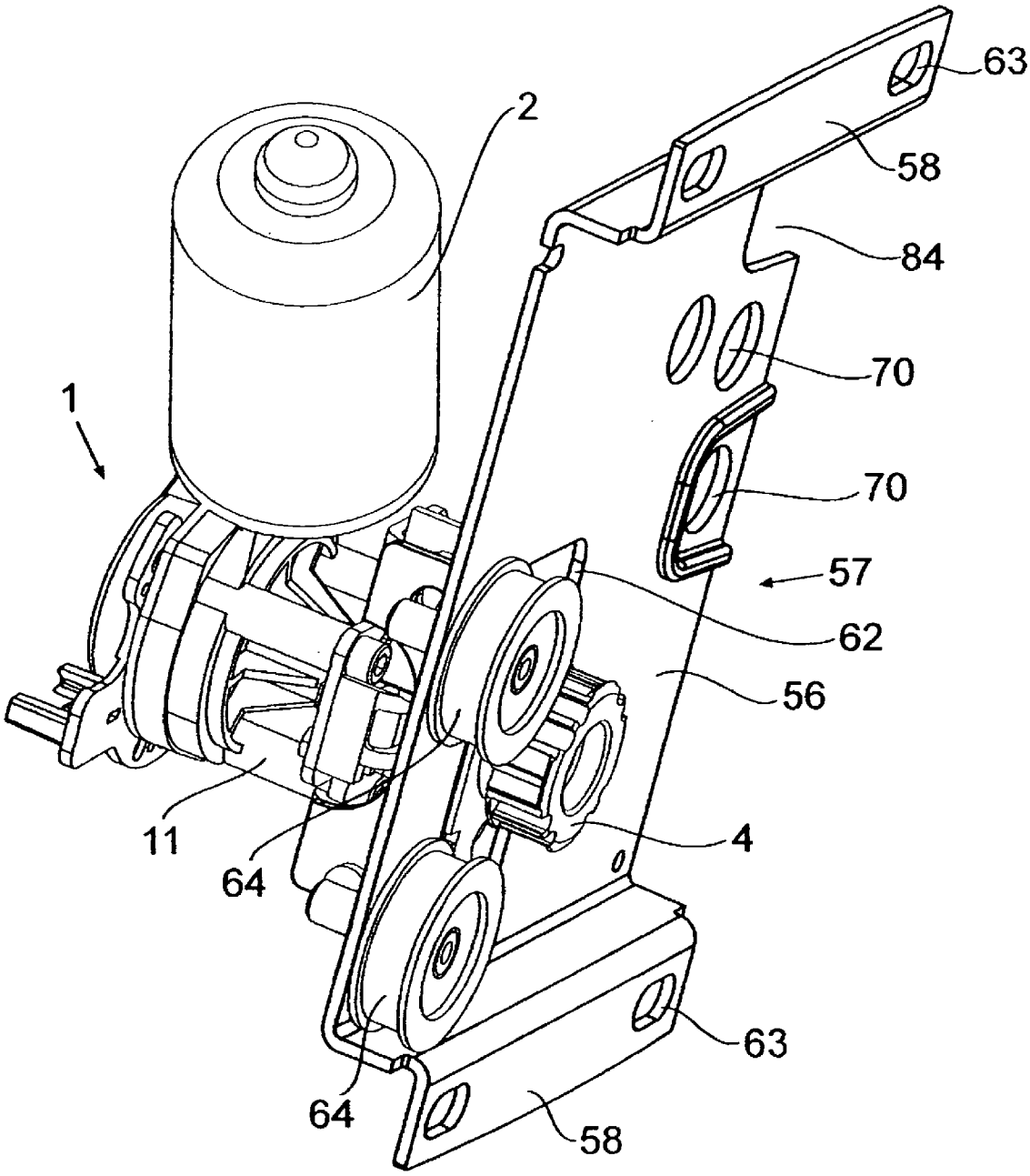
FIG. 12 is a perspective view of the third embodiment of the mounting unit with the power unit, viewed towards the drive gears.

FIG. 11 shows the connection of the power unit 1 with the mounting unit 57. The underside of the base plate 56 is revealed in the perspective view of FIG. 12, which was obtained by rotation of the whole unit (power unit 1 and mounting unit 57). The drive gear 4 extends through the opening 79 in the base plate 56 and cooperates with the guide rollers 64 to transmit power when a drive device is used. In addition, the base plate 56 has a recess 84 and apertures 70 for the passage of cables for the connection of electric lines.

Figure 13:
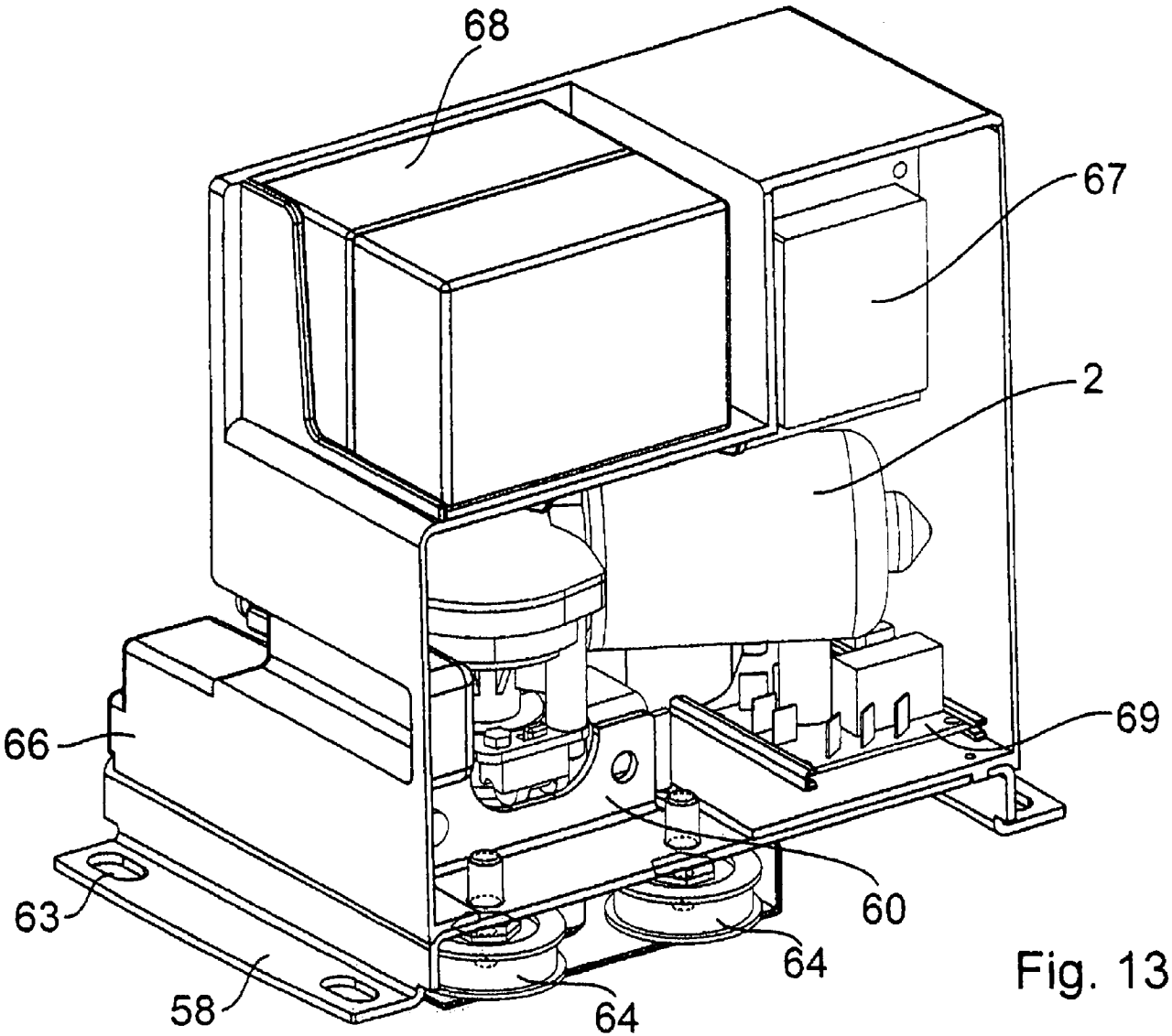
FIG. 13 shows a complete drive for different sectional doors with a housing, which is shown partially cutaway.

FIG. 13 shows a complete electromechanical drive with the third embodiment of a mounting unit 57. The drawing shows the joining of the power unit 1 with the mounting unit 57, as described above, as well as additional components, such as a transformer 67 and a power pack 69. To allow the drive to be operated independently of the power supply main, the housing 66 contains a storage battery 68.

Figure 14:
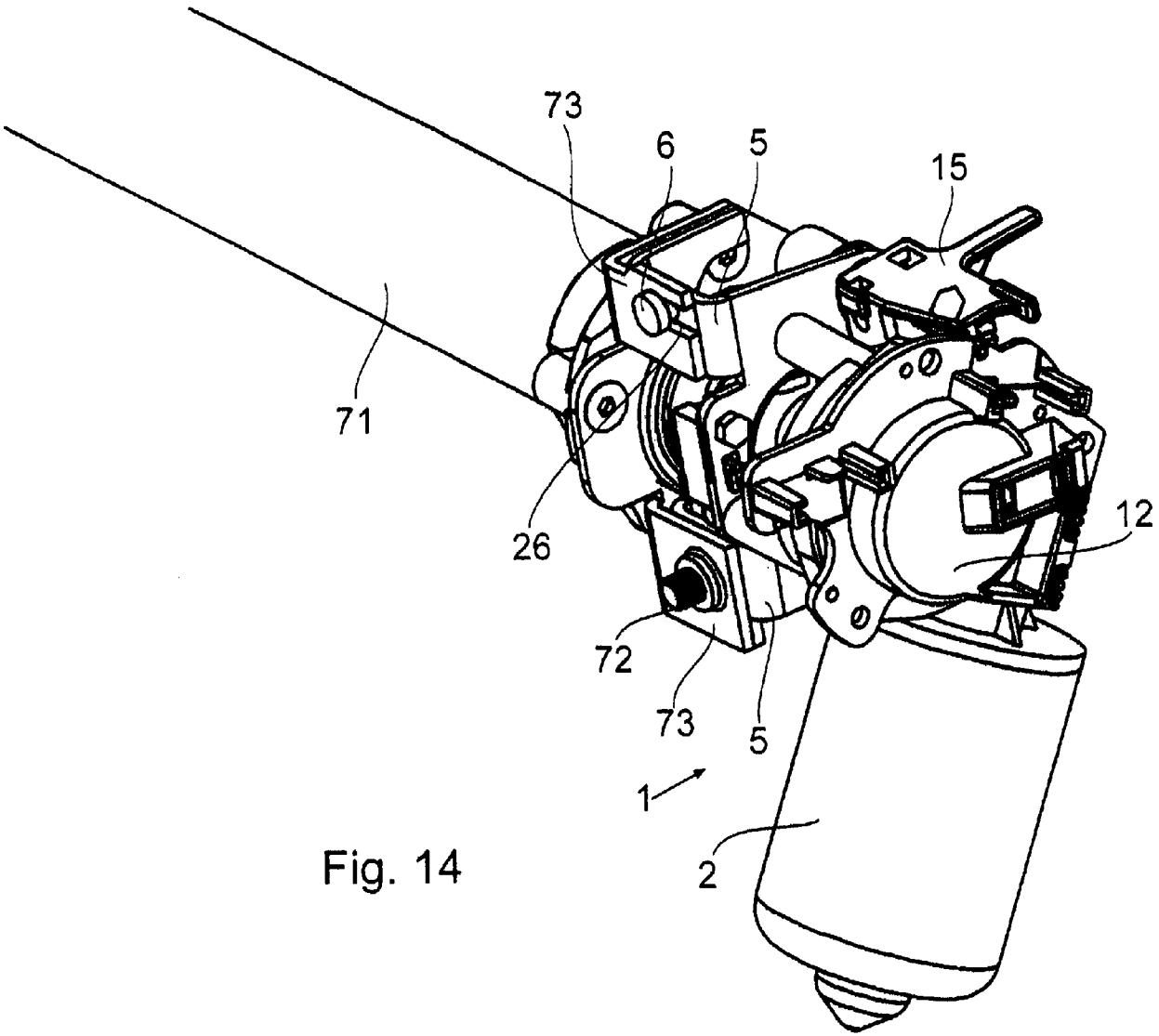
FIG. 14 is a perspective view of a fourth embodiment for a swing door drive with a power unit.
Figure 15:
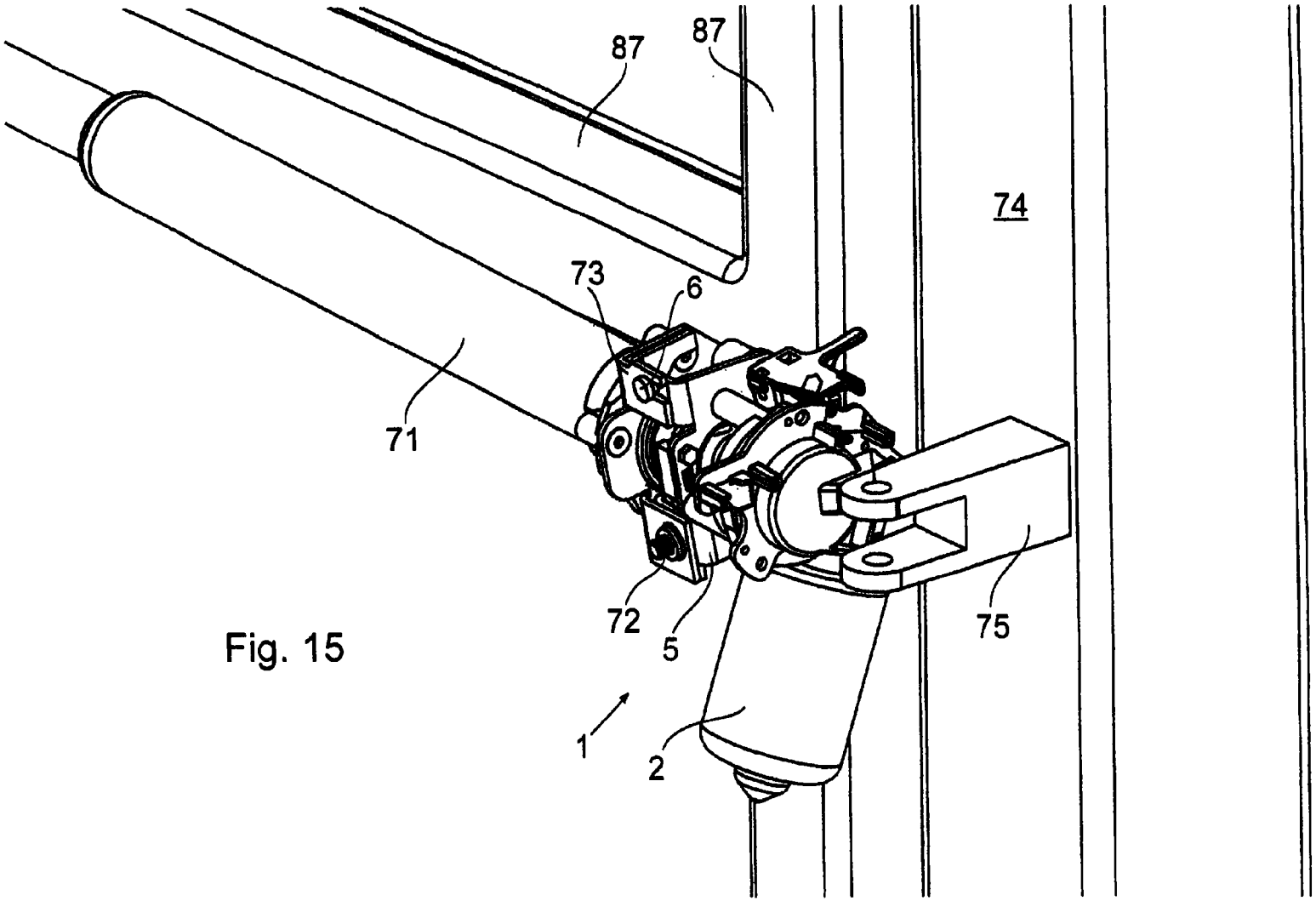
FIG. 15 shows a partial view of a swing door with a mounted power unit, without a housing.
Figure 16:
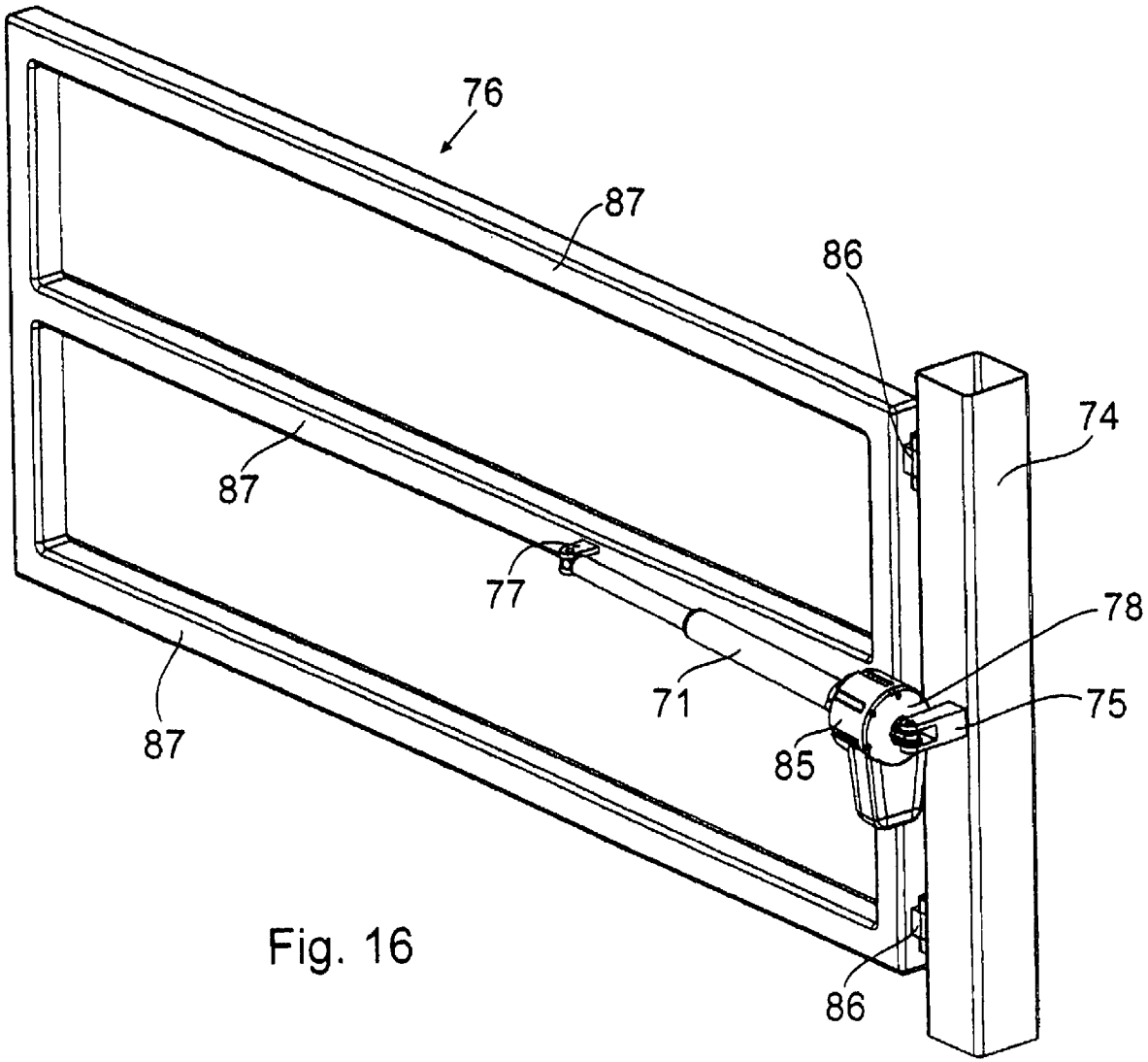
FIG. 16 shows a general view of a swing door with a complete drive with housing.

FIGS. 14-16 show another preferred embodiment, in which the power unit 1 is connected with a swing door device 71 for turning a swing door 76 or a swing door leaf. Here again, the same power unit 1 with its mounting bracket 5 is connected with a mounting flange 73, which is frictionally or positively mounted on the swing door device 71. In this case as well, the mounting flange 73 has a recess 26 for the mounting fixture 6 and a mounting hole for inserting a fastening bolt 72 through the slot 7 and the mounting hole.

FIG. 15 shows the swing door device 71, which preferably contains a spindle with a nut, wherein the spindle is rotated by the drive gear of the power unit, and the power unit 1 without a housing.

FIG. 16 shows a general view of the swing door 76 with a drive. In this embodiment, the swing door 76 consists of a frame 87 that is rotatably supported on an upright 74 by means of hinges 86. The housing 85 has a bearing shell 78, whose journal is rotatably supported in a stationary bearing bracket 75. A free end of the swing door device 71 also has a bearing, which is pivotably in a bearing bracket 77 on the frame 87.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An electromechanical drive for a door, the drive comprising:

a mounting unit mounted on a door, the mounting unit comprising a single stamped sheet of metal having a base plate and a pair of lateral sections, the lateral sections supporting a shaft, and a means for moving the door on the shaft;

a mounting bracket being interchangeably fixed to the mounting unit;

a motor supported on the mounting bracket;

a transmission connected to said motor and having an output shaft, said transmission being directly supported by and frictionally connected to the mounting bracket; and a drive gear fixed to the output shaft and cooperating with the means for moving the door;

wherein the means for moving the door comprises a driving pinion for cooperating with a toothed section of a running rail to move the door;

wherein the single stamped sheet of metal of the mounting unit further comprises at least one mounting flange extending from the lateral sections;

wherein the mounting bracket comprises at least one base shank; and wherein at least one of the mounting flange and the base shank has a recess extending in from an edge and the other of the mounting flange and the base shank has a mounting fixture being held in a recess on the mounting unit for interchangeably fixing the mounting bracket to the mounting unit.

2. The electromechanical drive of claim 1 further comprising a clutch installed in the output shaft between the drive gear and the transmission.

3. The electromechanical drive of claim 2 further comprising a position detecting device, a data output plug, a lever which moves when the clutch is shifted, and a switch which is operated by the lever to indicate a shift state of the clutch.

4. The electromechanical drive of claim 1 further comprising a position detecting device, the position detecting device comprising:

an incremental transmitter with a light barrier, the incremental transmitter comprising an information carrier which supplies pulses of uniform duration during each revolution of the motor; and a nonvolatile memory for storing the pulses.

5. The electromechanical drive of claim 4 wherein the incremental transmitter supplies a series of pulses during each revolution, the pulses in each series being of uniform duration except for one pulse of different duration.

6. The electromechanical drive of claim 1 wherein the mounting bracket has an essentially U-shaped profile and comprises the base shank and a pair of lateral mounting shanks.

7. The electromechanical drive of claim 6 wherein the transmission is mounted to one of the lateral mounting shanks by spacers.

8. The electromechanical drive of claim 6 wherein the base shank comprises the mounting fixture and a slot for securing the mounting bracket to the mounting unit.

9. The electromechanical drive of claim 8 wherein the mounting unit comprises the recess which receives the mounting fixture, and a threaded stud which is received through the slot for fixing the bracket to the mounting unit.

10. The electromechanical drive of claim 2 further comprising a clutch release lever for manually releasing the clutch.

11. The electromechanical drive of claim 1 wherein the mounting unit comprises a stamped and formed metal plate comprising a base plate, a pair of lateral sections formed to stand upright of the base plate, and a pair of mounting flanges formed to extend laterally of respective said lateral sections.

12. The electromechanical drive of claim 11 further comprising the shaft supported in a pair of shaft bearings in respective said lateral sections.

13. The electromechanical drive of claim 12 further comprising a coupling pinion on the shaft, the coupling pinion engaging the drive gear when the mounting bracket is fixed to the mounting unit.

14. The electromechanical drive of claim 13 further comprising a track roller on the shaft distally of said coupling.

15. The electromechanical drive of claim 14 wherein the track roller is designed as a gear wheel for cooperating with a toothed section of a guide rail.

16. The electromechanical drive of claim 1 wherein the mounting unit further comprises a roller bracket and at least one guide roller journaled on the roller bracket.

* * * * *

UNITED STATES PATENT AND TRADEMARK OFFICE

CERTIFICATE OF CORRECTION

PATENT NO. : 7,856,758 B2
APPLICATION NO. : 11/332404
DATED : December 28, 2010
INVENTOR(S) : Willi Ressel It is certified that error appears in the above-identified patent and that said Letters Patent is hereby corrected as shown below:

Title Page, item (73) should read;

--(73) Assignee: Novoferm ~~formatic~~ tormatic GmbH, Dortmund (DE)--

Signed and Sealed this
Fifteenth Day of March, 2011

David J. Kappos

David J. Kappos
*Director of the United States Patent and Trademark Office*